United States Patent [19]

Kita et al.

[11] 4,162,866

[45] Jul. 31, 1979

[54] H-SHAPED STEEL SHEET PILE WALL

[76] Inventors: Takeichi Kita; Takuji Kita, both of 2-288 Mineoka-cho, Hodogaya-ku, Yokohama-shi, Kanagawa-ken, Japan

[21] Appl. No.: 902,891

[22] Filed: May 4, 1978

[51] Int. Cl.[2] ..... E02D 5/08

[52] U.S. Cl. ..... 405/277; 405/278

[58] Field of Search ..... 61/60, 61, 62, 53; 405/277, 278, 276, 279

[56] References Cited

U.S. PATENT DOCUMENTS 3,698,149 10/1972 Baker et al. ..... 61/61

FOREIGN PATENT DOCUMENTS 524422 5/1931 Fed. Rep. of Germany ..... 61/60
571720 3/1933 Fed. Rep. of Germany ..... 61/60
10774 3/1924 Netherlands ..... 61/61

*Primary Examiner*—Jacob Shapiro
*Attorney, Agent, or Firm*—George B. Oujevolk

[57] ABSTRACT

In an H-shaped steel sheet pile wherein central parts of both side plates are coupled by a coupling plate, an engaging piece is formed at one edge of the side plate and a fitting piece adapted to snugly fit the engaging piece is formed at the other edge in such a manner that they are continuous along the respective edges, and fitting grooves are formed on both surfaces of the coupling plate in a manner to extend in opposition to each other in the lengthwise direction of the coupling plate, to form an H-shaped steel sheet pile (hereinbelow, termed an "AH-shaped steel sheet pile"). Apertures are opposingly provided at required positions of both the side plates of the AH-shaped steel sheet pile, to form an H-shaped steel sheet pile (hereinafter, called a "BH-shaped steel sheet pile"). A joining reinforcement member is formed at both its edges with protuberant pieces which are adapted to respectively fit the fitting grooves of the adjoining and opposing coupling plates, and has a top piece which contacts with the rear surfaces of the connected parts of the side plates. The sheet piles are fitted and coupled into one row by the joining reinforcement members, thereby to construct an H-shaped steel sheet pile wall.

3 Claims, 10 Drawing Figures

H-SHAPED STEEL SHEET PILE WALL

DETAILED DESCRIPTION OF THE INVENTION

1. Background of the Invention

This invention relates to an H-shaped steel sheet pile wall which can be used for the constructions of an oil tank, an oil embankment, a large-sized water tank, a silo, etc. or for the works of soil guards for pit excavation, a retaining wall, shore protection, temporary cut-off of water, a dam, a subway, large-scale sewerage, a canal, an artificial island, etc., and which prevents or reduces the loss or damages of human lives, dwellings, structures, farm products, etc. attributed to a typhoon, a windstorm, explosion or fire of the oil tank, etc.

2. Description of the Prior Art

In prior-art H-shaped steel sheet piles, the coupling part between the adjacent side plates of the H-shaped steel sheet piles is weak from the standpoint of the theory of structures and is liable to deformation. It is difficult to ensure a rigid coupling, and the function of the H-shaped steel sheet piles cannot be satisfactorily demonstrated. In addition, the sheet piles cannot be used as a disaster-preventing wall.

3. Objects of the Invention

An object of this invention is to provide an H-shaped steel sheet pile wall wherein respectively adjacent H-shaped steel sheet piles have their engaging pieces and fitting pieces fitted and coupled and are driven deep in the ground, to define box-shaped cavities, and joining reinforcements are driven into the cavities under the state under which protuberant pieces of each joining reinforcement are respectively snugly fitted in fitting grooves of coupling plates of the H-shaped steel sheet piles and under which a top piece of the joining reinforcement is held in contact with rear surfaces of connected parts of side plates of the H-shaped steel sheet piles, to reinforce the connected parts, whereby the H-shaped steel sheet pile wall is free from deformation as well as destruction and leakage of water and is stout.

Another object of this invention is to provide an H-shaped steel sheet pile wall wherein H-shaped steel sheet piles are fitted and coupled into a suitable length and are driven down to a suitable depth in the ground and then fixed, whereby the H-shaped steel sheet pile wall can be used as a disaster preventing wall against natural calamities such as typhoon and rainstorm or disasters of a petroleum tank etc.

DETAILED DESCRIPTION OF THE PREFERRED EMBODIMENT

Figure 1:
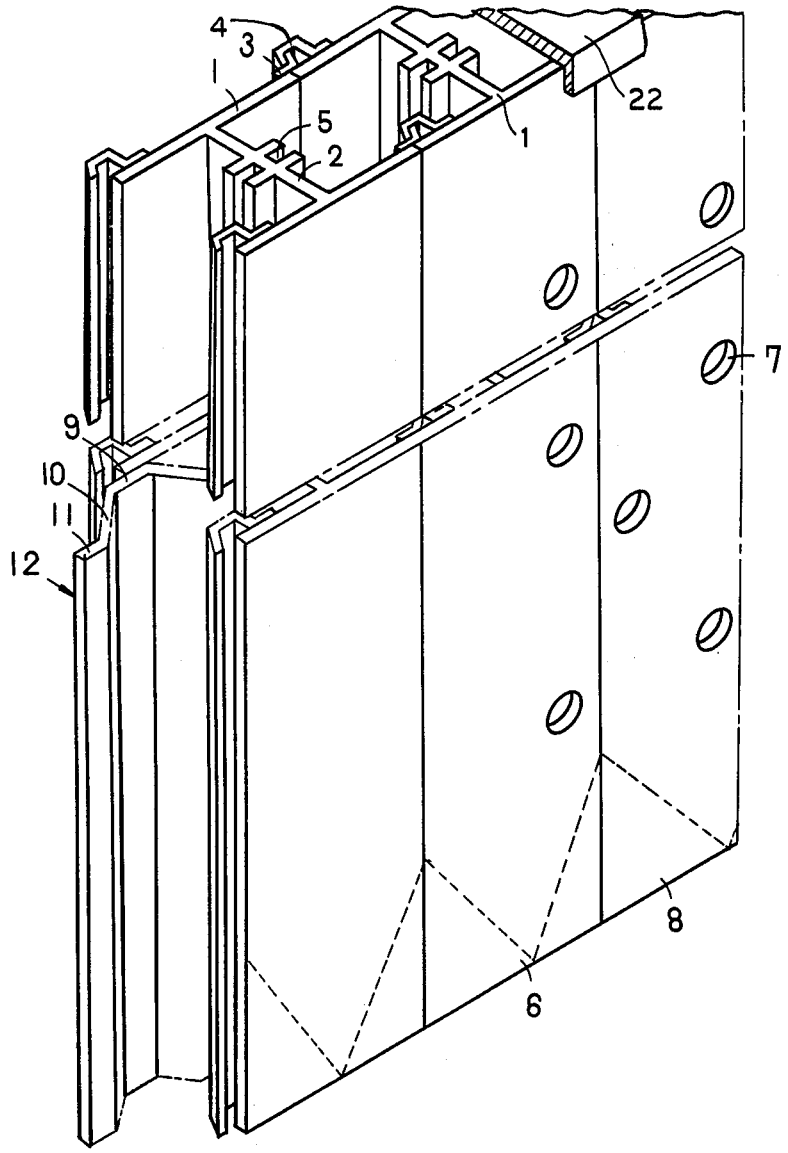
FIG. 1 is a perspective view, partially broken away, showing the essential portions of the construction of an embodiment.
Figure 2:
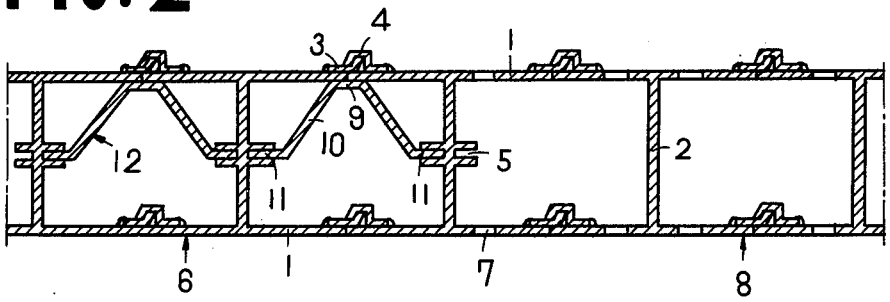
FIG. 2 is a horizontal sectional view.

An H-shaped steel sheet pile is so constructed that both side plates 1 are coupled by a coupling plate 2. In the H-shaped steel sheet pile, an engaging piece 3 is formed at one edge of each side plate 1 and a fitting piece 4 in a shape adapted to snugly fit the engaging piece 3 is formed at the other edge in such a manner that the pieces are continuous along the respective edges. On both surfaces of the coupling plate 2, fitting grooves 5 are provided in the lengthwise direction of the coupling plate and in opposition to each other. Thus, an AH-shaped steel sheet pile 6 is constructed. The AH-shaped steel sheet piles 6 are snugly fitted and coupled into one row, to form an AH-shaped steel sheet pile wall. In addition, a BH-shaped steel sheet pile 8 is disposed in which apertures 7 are opposingly provided at required positions of both the side plates 1 of the AH-shaped steel sheet pile 6. The BH-shaped steel sheet piles 8 are snugly fitted and coupled into one row, to form a BH-shaped steel sheet pile wall. Yet in addition, a joining reinforcement 12 is comprised which is bent and molded in the shape of a trestle with a top piece 9 and oblique pieces 10 and in which protuberant pieces 11 adapted to snugly fit the corresponding fitting grooves 5 are integrally molded at both edges thereof and in parallel with the top piece 9. Further, if necessary, a partition plate 13 for closing an open surface of the H-shaped steel sheet pile 6 or 8 is disposed. The partition plate 13 is provided with fitting pieces or engaging pieces 14 which snugly fit the engaging pieces 3 or fitting pieces 4 of the H-shaped steel sheet pile 6 or 8, and fitting grooves 15 in which the protuberant pieces 11 of the joining reinforcement 12 are snugly fitted.

In the execution of civil engineering works, the engaging pieces 3 of the side plates 1 are snugly fitted and driven into the fitting pieces 4 of the adjacent side plates 1. Subsequently, the protuberant pieces 11 of the joining reinforcement 12 are snugly fitted into the fitting grooves 5 of the coupling plates 2 opposing owing to the snug fit of the side plates, while the top piece 9 of the reinforcing member 12 is driven in contact with the rear surfaces of the connected side plates 1. Thereafter, the constituents are similarly coupled in succession, to construct an H-shaped steel sheet pile wall.

Figure 3:
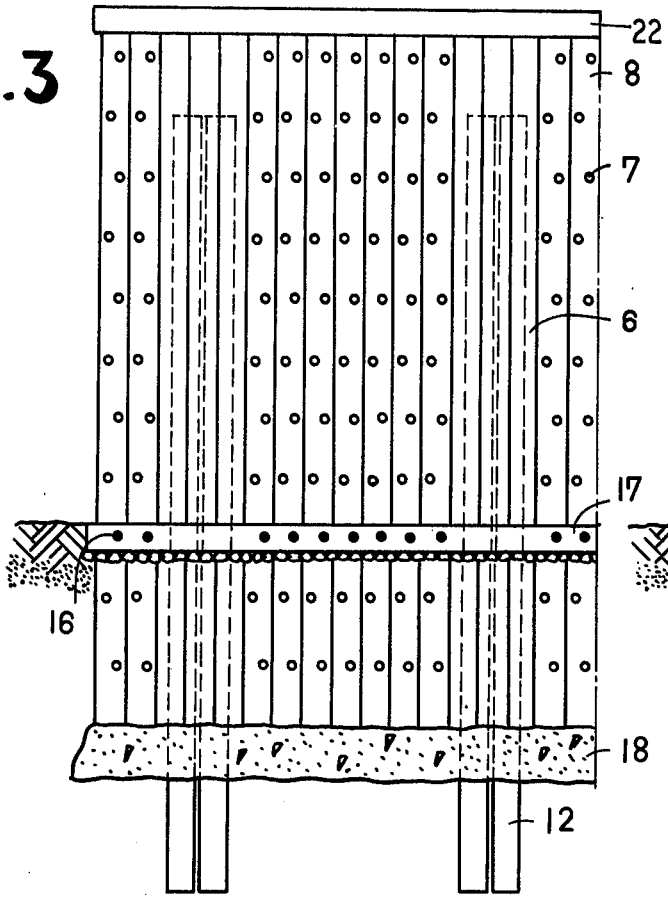
FIG. 3 is a front view showing one aspect of use.
Figure 4:
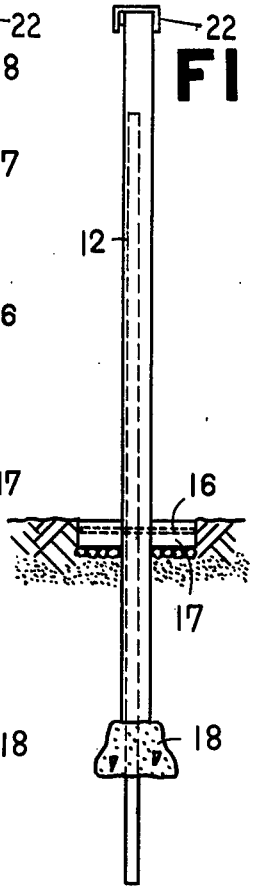
FIG. 4 is a side view corresponding to FIG. 3.
Figure 5:
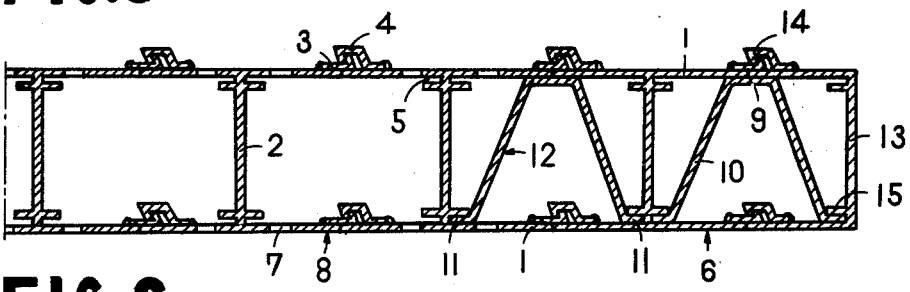
FIG. 5 is a horizontal sectional view showing another embodiment.
Figure 6:
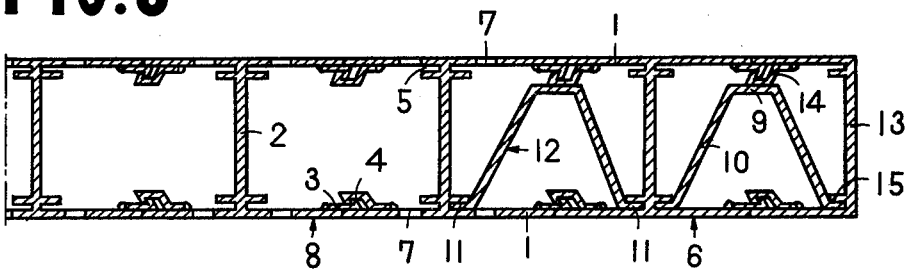
FIG. 6 is a horizontal sectional view showing a further embodiment.

In case of using the H-shaped steel sheet pile wall as a disaster-preventing wall against natural calamities such as typhoon and rainstorm, an overground height and an underground root depth which are required for the disaster preventive wall as shown in FIGS. 3 and 4 are surveyed, and the lengths of the AH-shaped steel sheet pile 6, the BH-shaped steel sheet pile 8 and the joining reinforcement 12 are determined. First, the BH-shaped steel sheet piles 8 are snugly fitted and coupled into a suitable length and are driven down to a suitable depth in the ground, to build a BH-shaped steel sheet pile wall. In this case, root binding members 16 are caused to penetrate through the apertures 7 near the ground surface and a foundation block 17 is made of concrete at suitable inner and outer widths. The opposing apertures 7 in a box-shaped cavity above the ground are left for air vents. A lower cavity is filled up with concrete which is tamped to form a bottom foundation 18. In this way, the BH-shaped steel sheet pile wall directly catches the typhoon or strong wind and moderates the ferocity thereof. The AH-shaped steel sheet piles 6 are snugly fitted in the BH-shaped steel sheet pile wall and then driven. The joining reinforcement members 12 are driven in such a manner that the proturberant pieces 11 are snugly fitted in the fitting grooves 5 within a box-shaped cavity of the AH-shaped steel sheet pile wall and that the top pieces 9 are held in contact with the rear surfaces of the fitting portions of the side plates 1. In case where, depending on the geology, the joining reinforcement 12 is to be driven deeper in the ground than the AH-shaped steel sheet pile wall, it can be driven deep in the box-shaped cavity so as to reach a hard stratum. Concrete is thrown into the box-shaped cavity of the AH-shaped steel sheet pile wall and is tamped to form a foundation.

Figure 7:
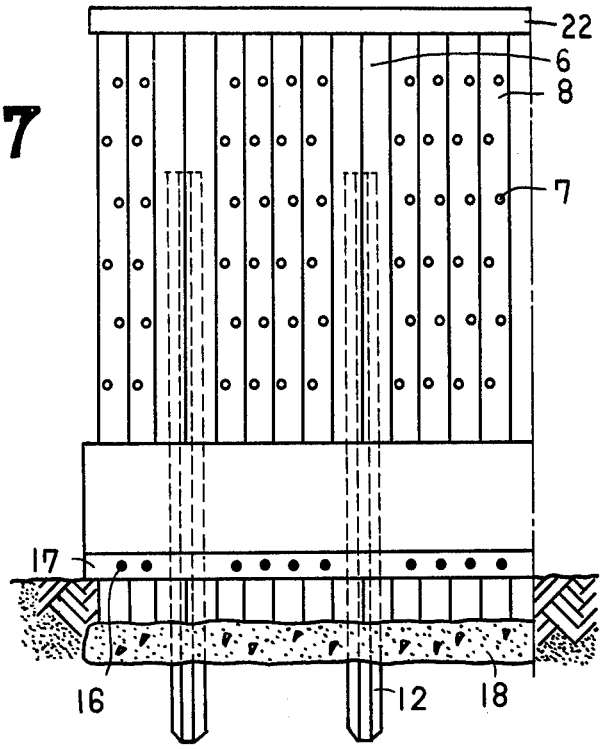
FIG. 7 is a front view showing another aspect of use.
Figure 8:
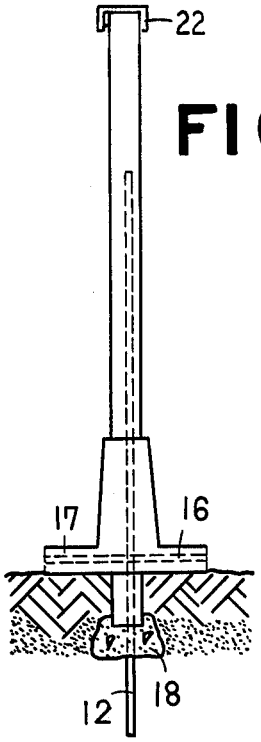
FIG. 8 is a side view corresponding to FIG. 7.
Figure 9:
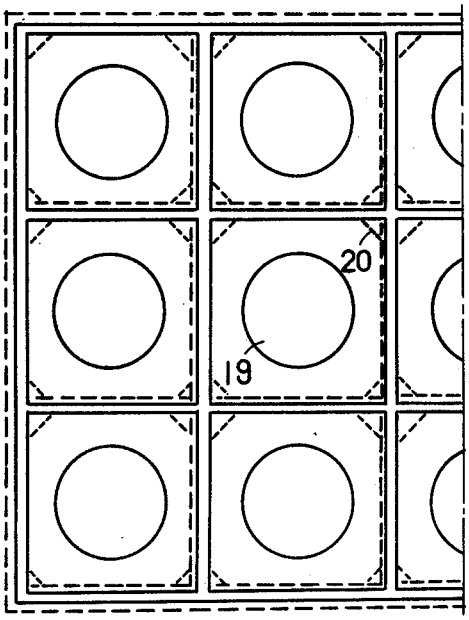
FIG. 9 is a plan view in the case where a disaster preventive wall is constructed in a manner to demarcate each of a group of oil tanks.

In case of using the H-shaped steel sheet pile wall as a disaster-preventing wall for a petroleum complex, every oil tank 19 is encompassed as shown in FIGS. 7 to 9 by coupling the AH-shaped steel sheet piles 6, the BH-shaped steel sheet piles 8 and the joining reinforcement members 12 as in the foregoing example of use and driving them at a sufficient rootage in the ground. A group of oil tanks are thus demarcated every tank, and the demarcated box-shaped cavity is filled up with concrete. Then, a stout wall for preventing disasters can be built. Concrete is further placed for reinforcement up to a suitable height inside and outside a waist part of the disaster-preventing wall erected as described above.

The apertures above the waist part are effective to average temperatures around the tank and inside and outside the disaster preventive wall by ventilation. Another effect of the apertures is that, in the event of a fire of the oil tank, the open air enters through the vents of the disaster preventive wall so as to upwardly burn petroleum within the tank demarcated by the disaster preventive wall, with the result that the spread of the fire to the adjacent oil tanks and the explosion thereof are prevented.

In order to prevent the disaster preventive wall from collapsing due to a blast, strong diagonal reinforcing bars 20 are respectively coupled at the four corners of the disaster preventive wall. Further, if necessary, bracing struts for reinforcement are disposed within the demarcation. Since a gigantic oil tank is very great in weight, it can incline and push up or down the site to induce a subsidence due to an earthquake or typhoon. If, in such a case, the oil tank is damaged, the outflow of petroleum will be caused. In this regard, the tank can be safely erected in such a way that the H-shaped steel sheet piles used in the disaster preventive wall are driven in the ground at a sufficient rootage so as to prevent the sideslip and movement of soil in the demarcation.

Figure 10:
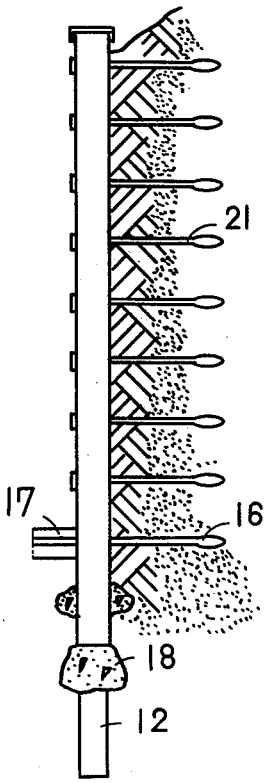
FIG. 10 is a side sectional view showing a further aspect of use.

In case of using the H-shaped steel sheet pile wall for the construction of a retaining wall, a sea or river wall, a dam or the like, the BH-shaped steel sheet piles 8 are coupled and are driven at a sufficient rootage as illustrated in FIG. 10. The root binding members 16, bracing members 21, etc. are caused to penetrate through the apertures 7, and they are driven deep in soil on the rear side and fixed. By utilizing some of the apertures 7, drip holes are provided. The AH-shaped steel sheet piles 6 are snugly fitted in the BH-shaped steel sheet piles 8 as main pillars at suitable intervals. The joining reinforcement members 12 are snugly fitted in cavities and driven down to a hard stratum. Concrete is packed in the cavities and tamped. In this way, a steel-skeleton concrete wall is constructed.

The H-shaped steel sheet pile wall can be used for various civil engineering works other than the foregoing examples, and can be applied to many fields as a disaster preventive wall.

As described above, according to this invention, the coupling of the H-shaped steel sheet piles is done at the edges of the side plates, and the joining reinforcement members are held in contact with the rear surfaces of the fitting parts of the H-shaped steel sheet piles. Therefore, the H-shaped steel sheet pile wall is very stout without undergoing any deformation. Since the coupling of the various members is done by the snug insertion and engagement, the sheet piles can be perfectly combined. Regarding the driving of the sheet pile, the interpenetration by hammering can be facilitated by working the front end of the root into the shape of a wedge. Furthermore, by throwing concrete into the cavities and tamping it, the coupling parts and both the foundation and the foundation block are made integral and rigid, and the operations can be executed simply and consecutively.

In case where the H-shaped steel sheet pile wall is feared to undergo a bending or the like deformation due to a strong wind, iron crowns 22 are mounted on head parts as head joining members in order to reinforce the sheet pile wall. The H-shaped steel sheet pile wall thus constructed is still stouter.

What I claim is:

1. An H-shaped steel sheet pile wall made of H-shaped units wherein in each unit central parts of two opposing side plates (1) are coupled by a coupling plate (2) comprising in combination:

(a) AH-shaped steel sheet pile units (6) each unit of which is formed with an engaging piece (3) at one edge of the side plate (1) and fitting piece means (4) adapted to fit said engaging piece (3), at the other edge of said side plate in a manner to be continuous along the respective edges of the side plates;

(b) fitting grooves (5) on both opposite surfaces of the coupling plates (2) in each unit in a manner to extend in a lengthwise direction of said coupling plate in opposition to each other;

(c) BH-shaped steel sheet pile units (8) each of which is provided with opposing apertures (7) at predetermined positions of both said side plates (1) of the AH-shaped steel sheet pile;

(d) joining reinforcement members (12) in the form of a trestle, with two edges, each of which has at both its edges protuberant pieces (11) adapted to fit said fitting grooves (5) of the adjacent and opposing coupling plates of the coupled steel sheet piles;

(e) A top piece (9) and oblique pieces (10) on each joining reinforcement member (12), contacting with the rear surface of connected parts of said side plates so that the sheet piles are fitted and coupled into one row by the use of said joining reinforcement members (11), the protuberant pieces (11) fitting snugly into the grooves (5) and being integrally molded at both edges thereof; and, (f) a partition plate (13) for closing the open surface of the H-shaped steel plate (6,8) with engaging pieces (14) which snugly fit the engaging pieces (3) and fitting piece means (4), and having fitting grooves (15) in which said protuberant pieces (11) are fitted.

2. A wall as claimed in claim 1 wherein said fitting grooves (5) are in the center of the coupling plate (2).

3. A wall as claimed in claim 1 wherein said fitting grooves (5) are at one end of said coupling plate (2).

* * * * *